US008523184B1

(12) United States Patent
Ershov et al.

(10) Patent No.: US 8,523,184 B1
(45) Date of Patent: Sep. 3, 2013

(54) TABLETOP GAME

(75) Inventors: Sergei Nikolaevich Ershov, Novgorod (RU); Aleksandr Igorevich Malyshev, Nizhny Novgorod (RU)

(73) Assignee: Lobachevsky State University of Nizhni Novgorod, Nizhny Novgorod (RU)

( * ) Notice: Subject to any disclaimer, the term of this patent is extended or adjusted under 35 U.S.C. 154(b) by 0 days.

(21) Appl. No.: 13/565,991

(22) Filed: Aug. 3, 2012

Related U.S. Application Data

(63) Continuation of application No. PCT/RU2012/000192, filed on Mar. 20, 2012.

(51) Int. Cl.
*A63F 7/00* (2006.01)

(52) U.S. Cl.
USPC ..... 273/317; 273/317.1; 273/317.3; 273/342

(58) Field of Classification Search
USPC ..... 273/317, 317.1, 317.3, 342
See application file for complete search history.

(56) References Cited

U.S. PATENT DOCUMENTS

| | | | | |
|---|---|---|---|---|
| 1,315,927 | A * | 9/1919 | Geib | 273/123 R |
| 1,523,686 | A * | 1/1925 | Davies | 273/317.3 |
| 1,653,545 | A * | 12/1927 | Buedingen | 273/317.3 |
| RE18,163 | E * | 8/1931 | Garver | 273/317.3 |
| 2,301,265 | A * | 11/1942 | Fandrey | 273/400 |
| 3,689,069 | A * | 9/1972 | Rogers et al. | 273/317.3 |
| 4,334,682 | A * | 6/1982 | Ham | 273/317.3 |
| 6,536,770 | B1 | 3/2003 | Yang | |
| 7,207,565 | B1 * | 4/2007 | Masty, III | 273/342 |
| 2003/0160387 | A1 | 8/2003 | Drury | |
| 2007/0205553 | A1 | 9/2007 | Turley | |
| 2007/0235941 | A1 * | 10/2007 | Ting | 273/317.3 |
| 2008/0217848 | A1 | 9/2008 | Kollmann | |

FOREIGN PATENT DOCUMENTS

| | | | |
|---|---|---|---|
| CN | 101337125 | A | 1/2009 |
| JP | 2007160064 | A | 6/2007 |
| JP | 2009039188 | A | 2/2009 |
| SU | 1771786 | A1 | 10/1992 |

OTHER PUBLICATIONS

International Search Report dated Dec. 13, 2012 for corresponding International Patent Application No. PCT/RU2012/000192 filed Mar. 20, 2012.

* cited by examiner

*Primary Examiner* — Raleigh W Chiu
(74) *Attorney, Agent, or Firm* — Patentbar International P.C.

(57) ABSTRACT

The invention relates to table or floor games based on throwing a ball into the game field, and can be used in organizing leisure and entertainment for both children and adults. The game comprises a game field with a plurality of holes and at least one movable trap for the ball outside the game field. The trap for the ball may be fixed to a rod, which is slidably mounted on a bar, said bar being attached to the sidewall, which limits the game field. The trap for the ball may be fixed to a rod, which is mounted on a movable platform.

10 Claims, 1 Drawing Sheet

TABLETOP GAME

FIELD OF THE INVENTION

The invention relates to table or floor games based on throwing a ball into the game field, and can be used in organizing leisure and entertainment for both children and adults.

BACKGROUND OF THE INVENTION

In the present invention, the term "ball" includes round objects capable of elastically rebounding from the surface onto which they are thrown.

Games based on throwing a ball into the game field with holes for receiving the ball are popular due to the fact that the result of the game largely depends on the skills of the player. However, many of the known games have a rather complicated design (for example, US2008217848 A1, 2008 Sep. 11, JP2009039188 A, 2009 Feb. 26). This impairs their performance and limits the possibilities of their embodiment in a portable version, which is required for such games to be used in various settings (at home, on holiday).

The present invention relates to structurally simple tabletop games that can be implemented in a portable version.

Among the structurally simple tabletop games, one finds the games based on moving the ball on the game field. In their number, there are some games that simulate the game of golf (US2007205553 A1, 2007 Sep. 6; US2003160387 A1, 2003 Aug. 28, etc.), as well as a game based on the movement of the ball with a cursor that is moved along the lines dividing the game field into squares having a hole in the center (JP2007160064 A, 2007 Jun. 28), etc.

As the closest analogue, one may choose any game that simulates the game of golf and has a game field limited by sidewalls with ball-receiving holes across the game field (US2007205553 A1, 2007 Sep. 6).

The drawback of the game simulating the game of golf is in that it is insufficiently entertaining, due to the fact that the accuracy of a shot depends only on the applied force and the direction of the shot. Another disadvantage is the fact that the imitation of golf requires a sufficiently large game field.

SUMMARY OF THE INVENTION

The technical result obtained by using the present invention is the enhancement of the game's entertaining properties and the possibility of implementing the game with small geometric dimensions.

To achieve the technical result, a table game comprising a game field with holes is provided with at least one trap for the ball, which is mounted outside the game field and may be repositioned.

In one of the possible options, the trap for the ball may be fixed on a rod, which is mounted on a bar such that it may be repositioned along it, the bar being attached to the side-wall limiting the game field.

The trap may be attached to the rod permanently.

The trap may be mounted on the rod such that it may slide along the rod.

In another embodiment, the trap for the ball may be attached to the rod that is mounted on a movable platform.

In this embodiment, the trap may also be attached to the rod permanently.

The size of the hole in the plane of the game field should be made such that the ball contacts the surface of the hole when entering the hole.

A variant is also possible in which the game is provided with a means for throwing the ball into the game field.

BRIEF DESCRIPTION OF THE DRAWINGS

The invention is explained in FIG. 1 and FIG. 2.

DETAILED DESCRIPTION OF THE PREFERRED EMBODIMENTS

The game comprises a flat game field 1 with holes 2. The game field is limited by a sidewall 3. Sidewall 3 prevents the escape of the ball from game field 1.

In the general case, game field 1 may be made rectangular, square or may have some other shape, and it should be made of a material with a high coefficient of elasticity, for example, of metal, wood, plastic, or hard rubber. Such an implementation facilitates multiple rebounds of the ball thrown into game field 1, and enhances the entertaining value of the game.

In the general case, holes 2 may be of different shape. To enhance the entertaining value of the game, the geometry of holes 2 should be such that their transverse dimensions in the plane of the game field allow the ball to enter the hole easily and to touch the surface of the hole. Holes 2 may be made spherical, parabolic, or have some other shape.

Distribution of holes 2 on game field 1 may be different, for example, uniform or chaotic. In the illustrated embodiment, the holes are uniformly distributed across game field 1.

Figure 1:
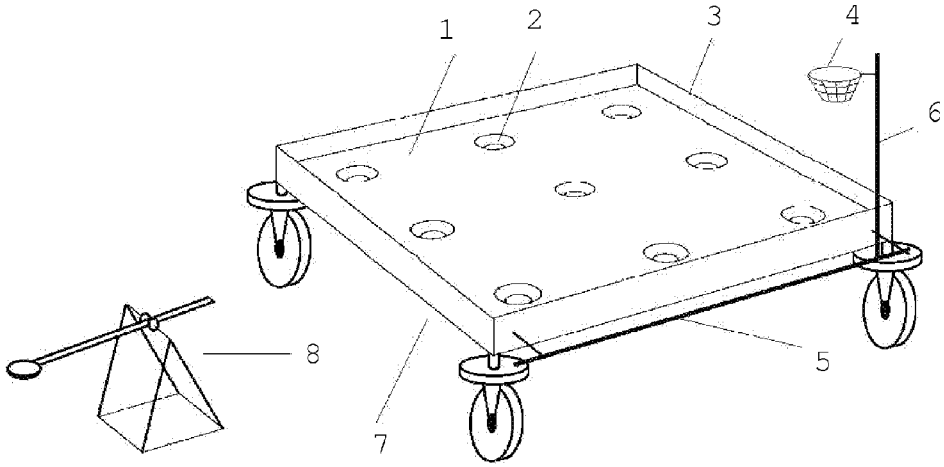
FIG. 1 schematically shows a possible variant of the claimed game characterized by rectangular shape of the game field, by the location of the semi-spherical holes in the field and by a trap for catching the ball.

Outside game field 1, one or more movable traps 4 for catching the ball are mounted (In FIG. 1, a single trap 4 is shown).

The means for repositioning each of the traps may be different. Trap 4 may be mounted on a movable base, such as a manually operated movable platform 7. In this case, trap 4 may be fixed permanently to the rod mounted on the platform, or said trap may be slidably mounted on the rod.

In the variant of the game shown in FIG. 1, trap 4 is moved along the edge of game field 1 along the bar 5, which is attached to the side surface of sidewall 3. Trap 4 is attached to rod 6, which is slidably mounted on bar 5. Trap 4 may be attached to rod 6 permanently, or it may be mounted on said rod slidably.

The number of traps 4 in the game may be different and is determined by the geometry of game field 1 and by the rules of the game. When game field 1 is round, the game may contain one trap 4; when game field 1 is rectangular, the game may contain more than one trap 4; when using two traps they may be mounted opposite each other.

The game may be provided with a means for throwing the ball into game field 1. In a particular embodiment of the game, a catapult 8 may be used to throw the ball at different angles to the plane of game field 1 and at different initial velocities.

Figure 2:
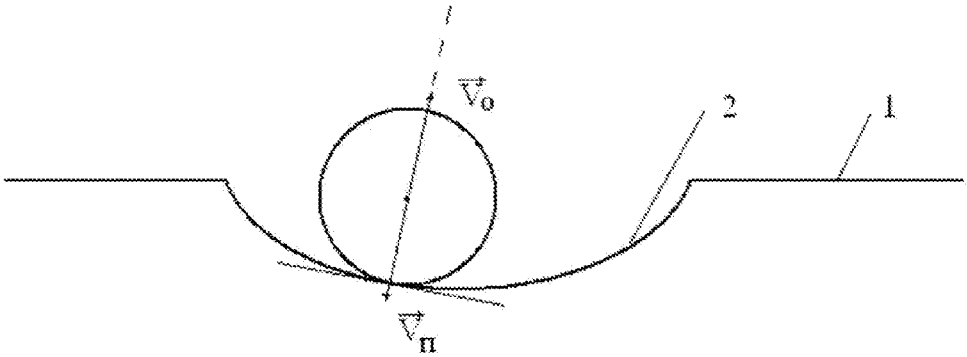
FIG. 2 shows the direction of the ball's rebound from the surface of the holes.

Entertaining value of the game is based on the features of the ball's rebound from game field 1 and from the surface of hole 2. While the direction of the ball's rebound from the horizontal surface of game field 1 is governed by the mirror reflection law (the angle of incidence equals the angle of reflection), the direction of the ball's rebound from the surface of hole 2 is determined by the angle of incidence of the ball falling into hole 2 and by the relationship of the geometric dimensions of the ball and hole 2. If at the moment when the ball falls into hole 2, vector Vπ of the ball velocity immediately before the impact coincides with the normal line to the surface of the hole, said normal line constructed from the tangency point of the ball and hole 2 (FIG. 2), vector Vo of the ball velocity at the rebound moment is diametrically opposite to vector Vπ. We call it the "back-reflection". If this condition is not satisfied, the rebound of the ball is governed by the law of mirror reflection.

The game may have different rules.

In particular, in one variant of the rules, the player tries to predict the rebound angle of the ball and moves trap 4 so as to catch the ball. The outcome of the ball game depends on the player's ability to predict the angle of reflection.

In another possible variant of the rules, the player should predict the angle of reflection of the ball so that the latter falls into trap 4 set at a fixed location.

Below is an example of the game rules for two players.

Traps 4 are located on opposite sides of the rectangular field 1.

Players take turns throwing the ball into game field 1. Each player seeks to impart to the ball such a velocity in terms of magnitude and direction that the ball hits one of holes 2 and is "back-reflected" therefrom. The task of the player is to make the ball fall after reflection into trap 4 located on the side of game field 1, from which the ball was thrown. In this case, the player scores the maximum number of points, for example, 10. If the ball, upon rebounds from the game field, falls into the other trap 4, the player scores fewer points, for example, 2. If the ball misses the traps, no points will be scored.

The winner is either the player scoring an initially specified number of points, for example, fifty, before his opponent, or the player scoring more points within the specified period of the game, for example, 10 minutes.

The game may be in demand with players of all ages, and the number of players is not limited. The game does not require a lot of time to complete the game cycle and can serve as a means for relieving stress during a short period of time.

What is claimed is:

1. A tabletop game, comprising a game field with holes, wherein there is at least one trap for the ball, said trap being movably mounted outside the game field; and wherein the trap for the ball is attached to a rod that is slidably mounted on a bar, said bar being attached to the sidewall, which limits the game field.

2. The tabletop game according to claim 1, wherein the trap for the ball is permanently attached to the rod.

3. The tabletop game according to claim 1, wherein the trap for the ball is slidably mounted on a rod.

4. The tabletop game according to claim 1, wherein the holes are made with such dimensions in the plane of the game field that ensure the contact of the ball with the surface of the hole when the ball enters said hole.

5. The tabletop game according to claim 1, wherein a means is provided for throwing the ball into the game field.

6. A tabletop game, comprising a game field with holes, wherein there is at least one trap for the ball, said trap being movably mounted outside the game field; and wherein the trap for the ball is fixed to a rod, which is mounted on a movable platform.

7. The tabletop game according to claim 6, wherein the trap for the ball is permanently attached to a rod.

8. The table game according to claim 6, wherein the trap for the ball is slidably mounted on a rod.

9. The tabletop game according to claim 6, wherein the holes are made with such dimensions in the plane of the game field that ensure the contact of the ball with the surface of the hole when the ball enters said hole.

10. The tabletop game according to claim 6, wherein a means is provided for throwing the ball into the game field.

* * * * *